US008607760B2

(12) United States Patent
Mornhinweg et al.

(10) Patent No.: US 8,607,760 B2
(45) Date of Patent: Dec. 17, 2013

(54) PORTABLE HANDHELD WORK APPARATUS AND METHOD OF MAKING THE SAME

(75) Inventors: Jürgen Mornhinweg, Allmersbach (DE); Michael Schmid, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 834 days.

(21) Appl. No.: 12/591,755

(22) Filed: Dec. 1, 2009

(65) Prior Publication Data

US 2010/0139608 A1 Jun. 10, 2010

(30) Foreign Application Priority Data

Dec. 1, 2008 (DE) ..... 10 2008 059 840

(51) Int. Cl.

| | |
|---|---|
| ***F02B 75/22*** | (2006.01) |
| ***F02B 67/00*** | (2006.01) |
| ***F02B 77/04*** | (2006.01) |
| ***F02B 77/00*** | (2006.01) |

(52) U.S. Cl.

USPC ..... 123/195 R; 123/195 E; 123/198 E; 123/195 C

(58) Field of Classification Search

USPC ..... 123/195 R

See application file for complete search history.

(56) References Cited

U.S. PATENT DOCUMENTS

| | | | | |
|---|---|---|---|---|
| 4,134,370 | A | 1/1979 | Iwahashi et al. | |
| 5,029,393 | A * | 7/1991 | Nagashima et al. | 30/383 |
| 5,133,310 | A * | 7/1992 | Hitomi et al. | 123/90.15 |
| 5,855,067 | A * | 1/1999 | Taomo et al. | 30/122 |
| 6,192,840 | B1 * | 2/2001 | Durr et al. | 123/41.65 |
| 6,363,618 | B1 * | 4/2002 | Durr | 30/381 |
| 6,647,946 | B2 * | 11/2003 | Ohsawa et al. | 123/195 R |
| 6,837,207 | B2 | 1/2005 | Bonde et al. | |
| 6,948,472 | B2 * | 9/2005 | Suzuki et al. | 123/198 D |
| 7,458,162 | B2 * | 12/2008 | Ossiansson et al. | 30/276 |

FOREIGN PATENT DOCUMENTS

RU 2 103 543 C1 1/1998

* cited by examiner

*Primary Examiner* — Lindsay Low
*Assistant Examiner* — Syed O Hasan
(74) *Attorney, Agent, or Firm* — Walter Ottesen P.A.

(57) ABSTRACT

A portable handheld work apparatus has at least one work tool which is driven by an internal combustion engine (2). The engine (2) has a crankcase (20) which is formed, at least in part, by a crankcase sump (28). The work apparatus has a housing component (4) of plastic. The crankcase sump (28) is made of metal and is injection molded into the housing component (4) of the work apparatus. The engine (2) has an ignition unit which includes an ignition module (31). A simple configuration of the work apparatus results when the ignition module (31) is fixed directly and electrically conductively to the metal crankcase sump (28). For making the work apparatus, at least one attachment element for attaching a work tool carrier is fixed on the crankcase sump (28) before the crankcase sump (28) is injection molded therearound by the material of the housing component (4).

20 Claims, 6 Drawing Sheets

PORTABLE HANDHELD WORK APPARATUS AND METHOD OF MAKING THE SAME

CROSS REFERENCE TO RELATED APPLICATION

This application claims priority of German patent application no. 10 2008 059 840.2, filed Dec. 1, 2008, the entire content of which is incorporated herein by reference.

FIELD OF THE INVENTION

The invention relates to a portable handheld work apparatus having at least one work tool driven by an internal combustion engine. The invention also relates to a method for making the portable handheld work apparatus.

BACKGROUND OF THE INVENTION

U.S. Pat. No. 7,458,162 discloses a motor-driven chain saw wherein a metal crankcase sump is injection molded into a housing component. A section is formed on the metal crankcase sump whereon attachment elements are fixed for attaching the guide bar. The guide bar lies against the metal crankcase sump.

Internal combustion engines in portable handheld work apparatus are usually spark ignited and incorporate an ignition unit having an ignition module. The ignition module has to be connected to ground. For this purpose, the ignition module is usually connected to the metal crankcase by a connecting lead.

SUMMARY OF THE INVENTION

It is an object of the invention to provide a portable handheld work apparatus of the kind described above which has a simple assembly while being of light weight and high stability. It is also an object of the invention to provide a method for making a portable handheld work apparatus.

The portable handheld work apparatus of the invention includes: an internal combustion engine including an ignition unit having an ignition module; a work tool driven by the engine; the engine including a crankcase; the crankcase being formed, at least partially, by a crankcase sump made of metal; a housing component made of a predetermined material and the crankcase sump being injection molded into the housing component; and, the ignition module being fixed directly and electrically conductively to the crankcase sump made of metal.

The method of the invention is for making the above work apparatus. The method includes the steps of: providing at least one attachment element for attaching a work tool carrier; fixing the attachment element on the crankcase sump; and, then, injection molding the material of the housing component around the crankcase sump.

The direct connection of the ignition module to the metal crankcase sump connects the ignition module directly to ground. A separate ground lead is therefore unnecessary so that the assembly of the work apparatus and the making thereof are simplified. With the connection of the ignition module to the metal crankcase sump, a high stability of the connection is furthermore attained. The ignition module is usually mounted on the outer periphery of the fan wheel mounted on the crankshaft and coacts with magnets which are embedded in the fan wheel. The short tolerance chain between the fan wheel and the position of the ignition module is provided because the ignition module is tied directly to the crankshaft so that a precise positioning of the ignition module is possible in a simple manner. The crankcase sump delimits the crankcase and forms an inner wall of the crankcase.

Advantageously, the crankcase sump has an outwardly projecting arm whereon the ignition module is fixed. The arm especially has two attachment stubs which project out from the material of the housing component and on which the ignition module is fixed. The position of the ignition module relative to the arm is clearly determined because the arm has at least two attachment stubs. An electrically conducting connection is possible in a simple manner because the attachment stubs project out from the material of the housing component. The work apparatus has at least one tank for operating means with the tank being at least partially delimited by the housing component. The tank likewise comprises plastic and is integrated into the housing component. In this way, a simple assembly results.

The work apparatus has at least one attachment element for a work tool carrier of the work tool. The attachment element is advantageously fixed to the crankcase sump. Forces taken up by the work tool carrier can be conducted away in an excellent manner because the attachment element is fixed to the metal crankcase sump. This results in a high stability of the work apparatus while at the same time providing a comparatively low structural size. Advantageously, the housing has a support surface for the work tool carrier and the attachment element projects through the support surface. The crankcase sump has an end face disposed facing toward the support surface and the end face is offset into the interior of the housing component relative to the support surface and the end face is at a distance to the support surface with this distance being measured perpendicularly to the support surface. The crankcase sump thereby does not project up to the work tool carrier; instead, the crankcase sump is at a distance to the work tool carrier. In this way, the crankcase sump can be configured to be comparatively light and small. The distance between the end face and the support surface is bridged by the attachment element which is configured to be correspondingly long. The crankcase sump does not project up to the support surface and, for this reason, it is possible to utilize a crankcase sump for work apparatus of different size, for example, in a line of work apparatuses of different sizes. The different distances of the crankcase sump to the work tool carrier are bridged by attachment elements of different sizes. In this way, the manufacture of the work apparatus, especially of a series of work apparatuses, is simplified. The offset of the end face relative to the support surface into the interior of the housing component is a novel inventive concept. This configuration can also be advantageous in work apparatuses wherein the ignition module is not fixed directly on the crankcase sump.

The crankcase sump has two bearing seats for crankshaft bearings. The distance of the support surface to the end face is advantageously approximately one third to approximately three times the spacing of the two bearing seats. The attachment element is advantageously surrounded by the material of the housing component between the support surface and the end face. A portion of the forces, which are taken up by the attachment element, can, in this way, be conducted away directly into the plastic material of the housing component. The surface of the attachment element is configured to be smooth in the region surrounded by the material of the housing component. In this way, an exchange of the attachment element is possible even when the attachment element together with the crankcase sump is injection molded therearound by the material of the housing component.

The attachment element has a collar which joins flush with the support surface with this collar being embedded in the material of the housing component. Advantageously, the collar lies against the work tool carrier so that forces from the work tool carrier can be taken up directly via the collar. The collar is braced on the material of the housing component so that a portion of the taken-up forces are directly conducted into the material of the housing component.

Advantageously, the crankcase sump has a support section whereon the attachment element is fixed. A region of the crankcase sump delimits the crankcase. Advantageously, the support section projects outwardly from this region and has struts so that there results a crankcase sump having high strength. The attachment element is especially an attachment bolt which threadably engages in the crankcase sump.

It is practical to provide a second attachment element for the work tool carrier fixed in the material of the housing component and at a spacing to the crankcase sump. The attachment element, which is threadably engaged in the crankcase sump, is essentially sufficient for taking up the forces directed into the work tool carrier during operation. The second attachment element functions essentially to ensure the position of the work tool carrier. Only low forces of the work tool carrier need be taken up by the second attachment element. For this reason, the fixation of the second attachment element in the plastic of the housing component is sufficient. The crankcase sump can be configured to be comparatively short because the second attachment element is not fixed on the crankcase sump. It is practical when the second attachment element is the attachment element disposed farther away from the crankshaft of the internal combustion engine. In this way, a lower weight of the crankcase sump overall results.

Advantageously, the work apparatus has an oil pump, which is driven by the engine, for supplying the work tool with lubricating means. Advantageously, the crankcase sump has positioning means for fixing the position of the oil pump. In this way, a precise positioning of the oil pump relative to the crankshaft of the engine can be achieved in a simple manner. A short chain of tolerances results. It is practical when the oil pump is attached directly to the crankcase sump. It can, however, also be provided that the oil pump is attached to the housing component and only the positioning of the oil pump takes place on the crankcase sump. The region of the crankcase sump whereat the oil pump is attached is advantageously not injection molded therearound by the material of the housing component. In order to obtain a precise positioning, the positioning means are spaced from attachment locations whereat the oil pump is attached to the crankcase sump. Accordingly, the positioning of the oil pump does not take place at the attachment locations itself but at positioning means configured separately thereto.

For a method for making the work apparatus, at least one attachment element for attaching a work tool carrier is fixed at the crankcase sump before the crankcase sump is injection molded therearound by the material of the housing component. Accordingly, the crankcase sump together with the attachment element arranged thereon is placed in the mold for making the housing component and is injection molded together therewith.

The common injection molding of attachment element and crankcase sump translates into a simple manufacture.

Advantageously, the attachment element is threadably engaged in the crankcase sump. Because the attachment element is threadably engaged in the crankcase sump in advance of injection molding, the screw openings need not be protected during the injection process against the penetration of plastic. Because the attachment element is threadably engaged in the crankcase sump, it is ensured that the attachment element can be later easily exchanged.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
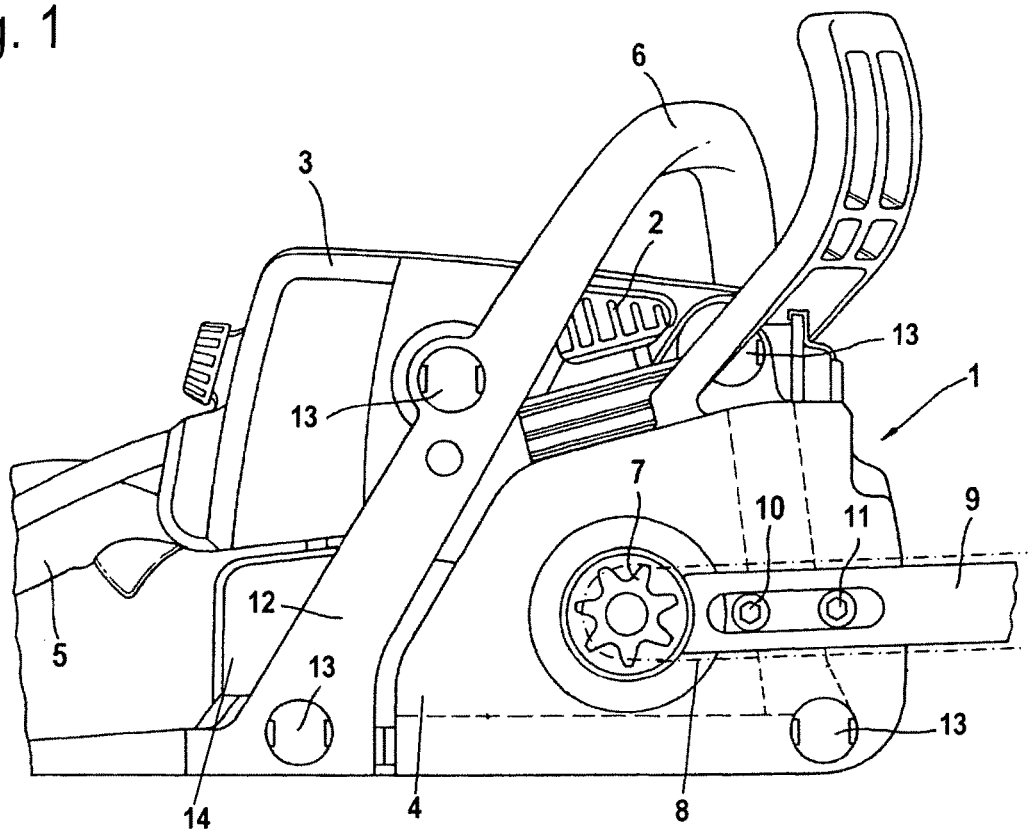
FIG. 1 is a schematic side elevation view of a motor-driven chain saw.

In FIG. 1, a motor-driven chain saw 1 is schematically shown as an embodiment for a portable handheld work apparatus. The motor-driven chain saw 1 has an internal combustion engine 2 which is mounted in a housing component 4. The housing component 4 is configured as a motor housing and is closed off by a housing cover 3. A handle housing 12 is fixed to the motor housing via anti-vibration elements 13. The handle housing 12 includes a rearward handle 5 as well as a grip tube 6. A fuel tank 14 is additionally fixed on the handle housing 12. The fuel tank 14 is advantageously configured as one piece with the handle housing 12 and integrated therein.

The internal combustion engine 2 is configured as a single-cylinder engine and can advantageously be a two-stroke engine. The engine 2 can, however, also be a four-stroke engine. The internal combustion engine 2 drives a drive sprocket 7 on which a saw chain 8 is arranged. The saw chain 8 is guided on a guide bar 9. The guide bar 9 is fixed to the housing component 4 via two attachment bolts 10 and 11. The cutting forces, which are conducted into the guide bar, are taken up via the attachment bolts 10 and 11.

Figure 2:
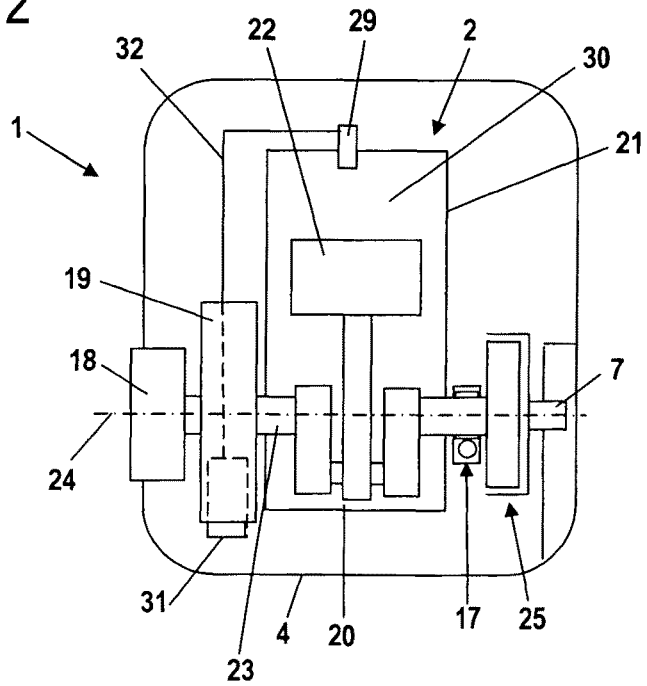
FIG. 2 is a schematic section view through the motor-driven chain saw of FIG. 1.

FIG. 2 shows schematically the configuration of the motor-driven chain saw 1. The motor-driven chain saw 1 has a starter unit 18 for the engine 2 which can be manually or electrically actuated. A fan wheel 19 is mounted between the starter unit 18 and the engine 2. The fan wheel 19 is attached to the crankshaft 23 of the engine 2 so as to rotate therewith. The crankshaft 23 is rotatably journalled in a crankcase 20 of the engine 2. The engine 2 has a cylinder 21 connected to the crankcase 20. A piston 22 is disposed in the cylinder 21 for reciprocating movement. The piston 22 rotatingly drives the crankshaft 23 about a rotational axis 24. The piston 22 delimits a combustion chamber 30 into which a spark plug 29 projects. The spark plug 29 is connected to an ignition module 31 via a lead 32 and the ignition module 31 supplies the spark plug 29 with energy. The ignition module 31 is mounted on the outer periphery of the fan wheel 19 and coacts with magnets embedded in the fan wheel 19 which induce a voltage in the ignition module 31. The ignition module 31, spark plug 29 and lead 32 conjointly define the ignition unit of the engine 2.

The crankshaft 23 drives an oil pump 17 which is mounted on the crankshaft 23 on the side of the engine 2 lying opposite to the fan wheel 19. The crankshaft 23 is connected to the drive sprocket 7 via a centrifugal clutch 25 mounted next to the oil pump 17.

Figure 3:
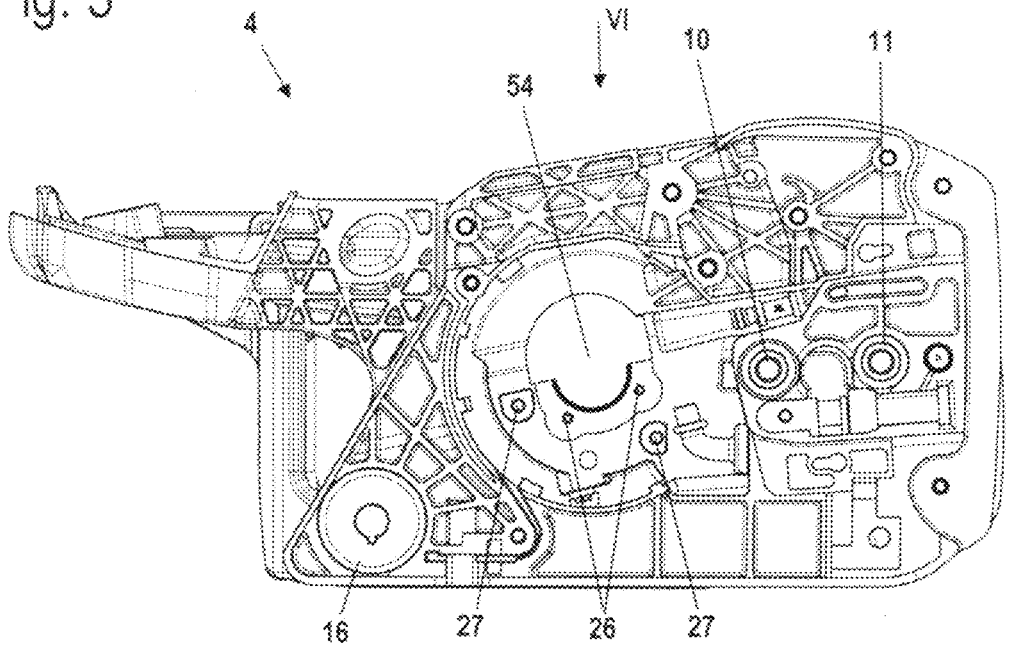
FIG. 3 is a side elevation view of a housing part of a motor-driven chain saw.
Figure 5:
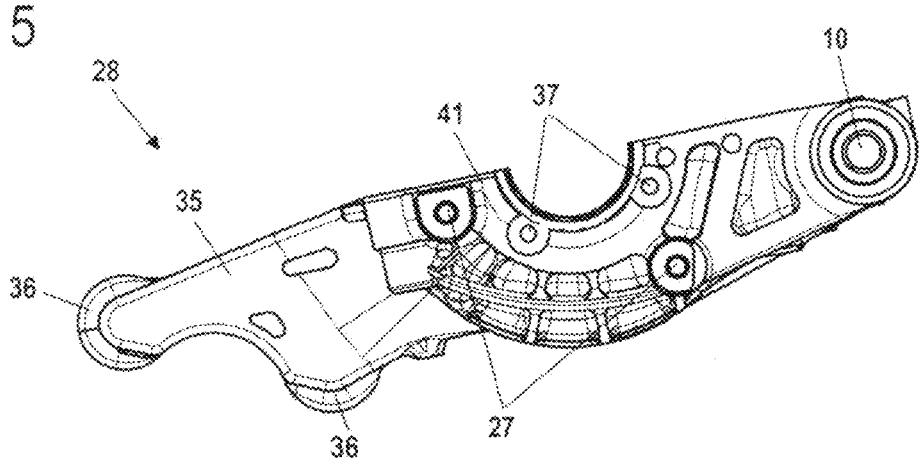
FIG. 5 shows the crankcase sump of the housing component in the side elevation view of FIGS. 3 and 4.

FIG. 3 shows the housing component 4 in a side elevation view. The housing component 4 has a receptacle 16 for an anti-vibration element 13 (FIG. 1). The housing component 4 is configured of plastic as an injection molded part and has a series of struts for strengthening and for optimizing weight. The housing component 4 advantageously comprises polyamid, especially PA 66. In order to obtain an adequate strength, the housing component 4 is advantageously reinforced with glass fibers. A crankcase sump 28 is injection molded into the housing component 4 which is shown in FIG. 5 and delimits the crankcase 20. The crankcase sump 28 is made of metal and forms the lower housing shell for the crankcase 20. The crankcase sump 28 has two receptacles 37 for positioning pins 26, which are shown in FIG. 3, and two attachment openings 27 for the oil pump 17. As shown in FIG. 5, the attachment bolt 10, which is next to the crankcase 20, is also fixed on the crankcase sump 28. Furthermore, the crankcase sump 28 has an arm 35 whereon two attachment supports 36 are provided.

As shown in FIG. 3, the positioning pins 26 project out from the material of the housing component 4 toward the outside. The attachment openings 27 are also provided on the outer side of the housing component 4 and are not injection molded therearound by the material of the housing component 4.

Figure 4:
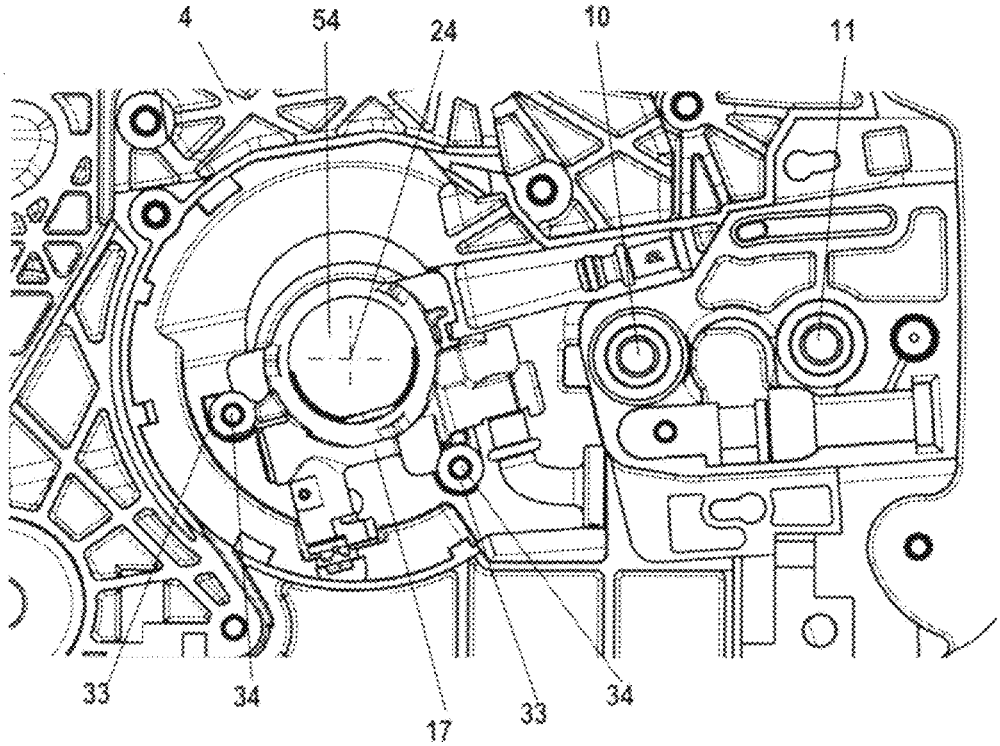
FIG. 4 is a detail cutaway of the side elevation view of FIG. 3 with an oil pump mounted on the housing component.

FIG. 4 shows the oil pump 17 on the housing component 4. The oil pump 17 is mounted in the region of the rotational axis 24 of the crankshaft 23 and has two attachment eyelets 33 in the region of the attachment openings 27. In the embodiment, the oil pump 17 is held in the attachment openings 27 by pins 34. However, threaded fasteners or the like can also be used to secure the oil pump 17. The positioning pins 26 are mounted spaced to the attachment openings 27 next to a passthrough opening 54 for the crankshaft 23. The position of the oil pump 17 to the crankshaft 23 is fixed by the positioning pins 26.

Figure 6:
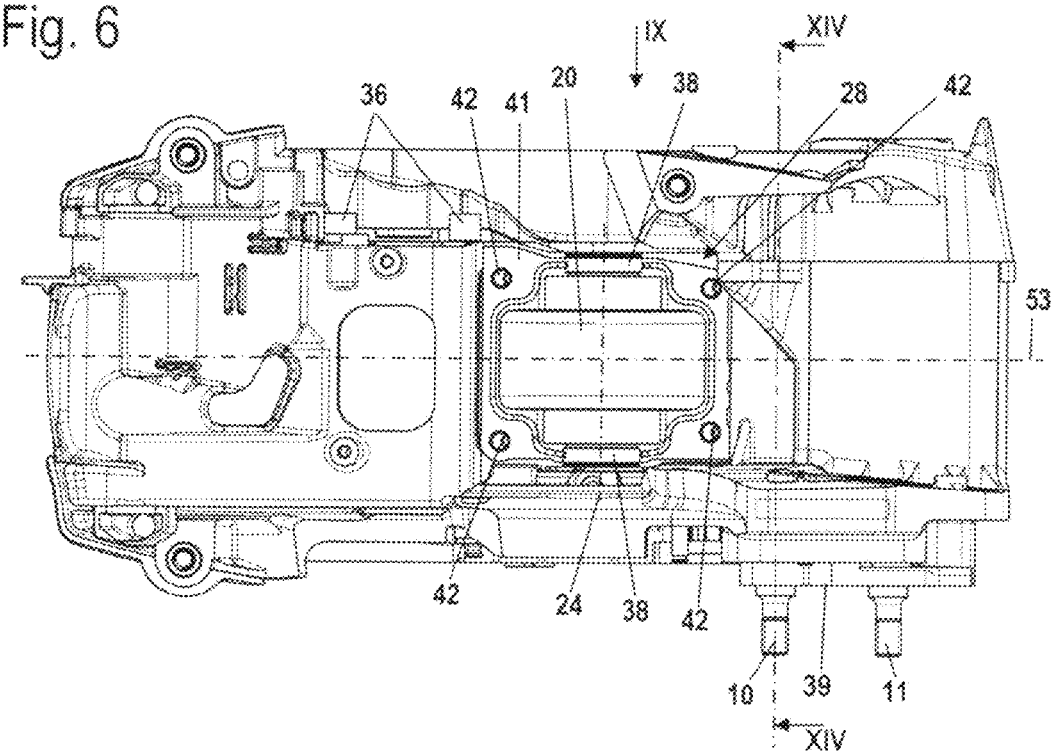
FIG. 6 is a side elevation view of the housing component viewed in the direction of arrow VI of FIG. 3.

As FIG. 6 shows, the motor-driven chain saw 1 has a longitudinal center plane 53 which runs parallel to the plane of the guide bar 9 (FIG. 1). The attachment bolts 10 and 11 and the attachment stubs 36 for the ignition module 31 project out of the housing component 4 at opposite-lying sides of the longitudinal center plane 53.

Figure 7:
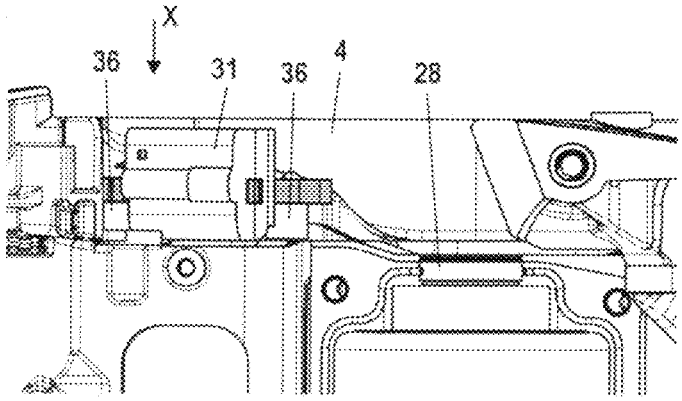
FIG. 7 is a cutaway view of the side view of FIG. 6 with an ignition module arranged on the housing component.
Figure 8:
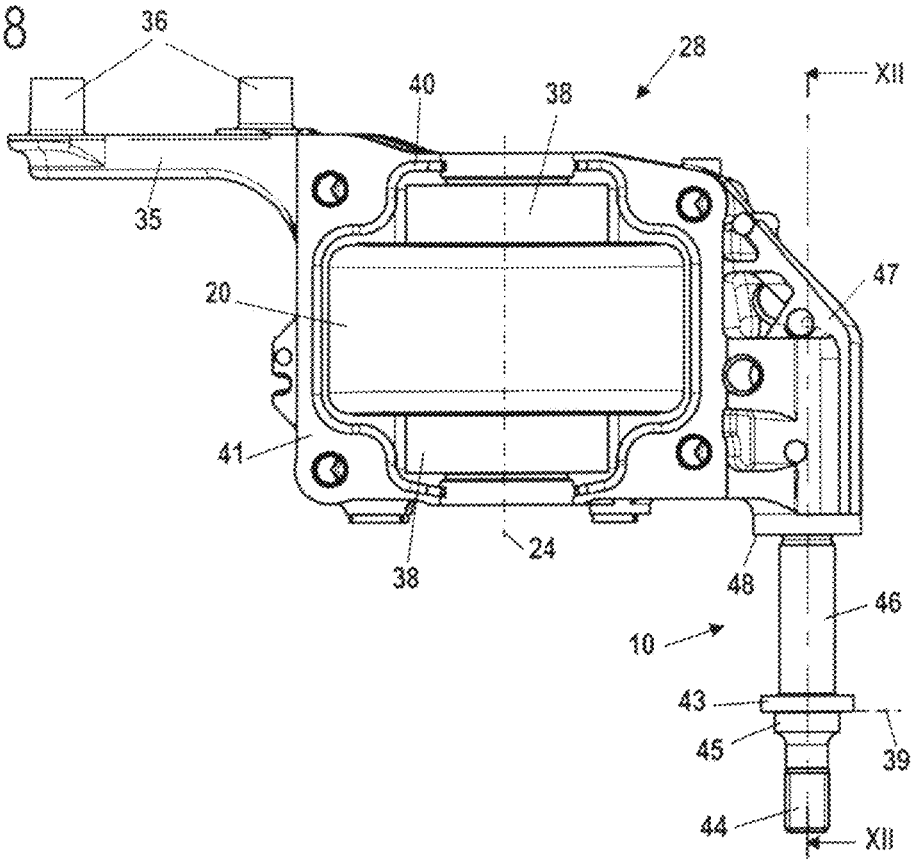
FIG. 8 shows the crankcase sump in the side elevation view of FIG. 6.

As shown in FIGS. 6 to 8, the arm 35 is arranged on the side of the crankcase sump 28, which faces toward the rearward handle 5 (FIG. 1), and on the side lying opposite to the guide bar 9. The arm 35 is configured to be flat in the direction of the rotational axis 24 of the crankshaft 23. As FIG. 6 shows, the arm is injected into the material of the housing component 4; whereas, the two attachment stubs 36 project out from the material of the housing component 4. As FIG. 7 shows, the ignition module 31 is fixed at the two attachment stubs 36, especially, the ignition module is held with threaded fasteners. A sheet metal packet 55 of the ignition module 31 lies on the attachment stubs 36. An electrically conductive connection between the ignition module 31 and the attachment stubs 36 of the crankcase sump 28 is established by the attachment screws.

As shown in FIGS. 6 and 8, the crankcase sump 28 has a connecting flange 41 for connecting to the cylinder 21 of the engine 2. The connecting flange 41 has four bores 42 for attachment screws. A slot 40 is provided in the connecting flange 41 which takes up a seal (not shown) for sealing the crankcase sump 28 relative to the cylinder 21. Two bearing seats 38 are provided in the crankcase sump 28 and are at a distance (b) from each other. The distance (b) is measured between the inner-lying edges of the bearing seats 38. The bearing seats 38 accommodate roller bearings for journaling the crankshaft 23.

As shown in FIG. 6, the housing component 4 forms a support surface 39 for the guide bar 9 in the region of the attachment bolts (10, 11). As shown schematically in FIG. 8, the support surface 39 is flush with the collar 43 of the attachment bolt 10. The attachment bolt 10 is threadably engaged in the crankcase sump 28. For this purpose, the crankcase sump 28 has a support section 47 which extends on the side facing away from the rearward handle 5 (FIG. 1). The support section 47 has an end face 48 which lies facing toward the support surface 39. In the region bordering on the end face 48, the attachment bolt 10 has a bridging section 46 which is cylindrical and is configured to have a smooth surface. The collar 43 joins at the bridging section 46. The attachment bolt 10 furthermore has a guide section 45 on which the guide bar 9 is held as well as a threaded stub 44 extending therefrom with which the guide bar 9 is clamped against a housing cover (not shown) and is fixed thereby.

Figure 9:
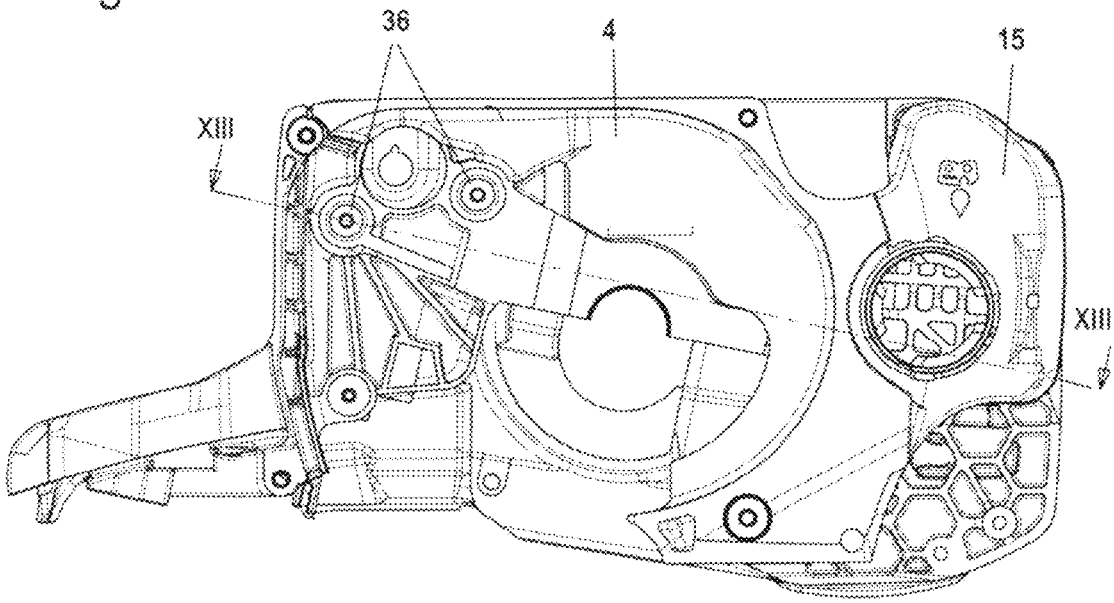
FIG. 9 is a side elevation view taken in the direction of arrow IX of FIG. 6.

As shown in FIG. 9, a lubricating oil tank 15 is integrated into the housing component 4 and this tank 15 is delimited entirely by the housing component 4.

Figure 10:
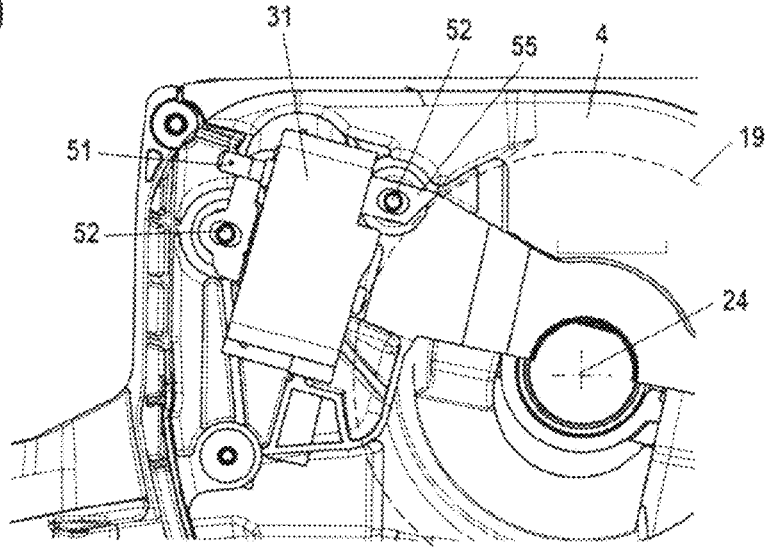
FIG. 10 is a side elevation view as seen in the direction of arrow X of FIG. 7.
Figure 11:
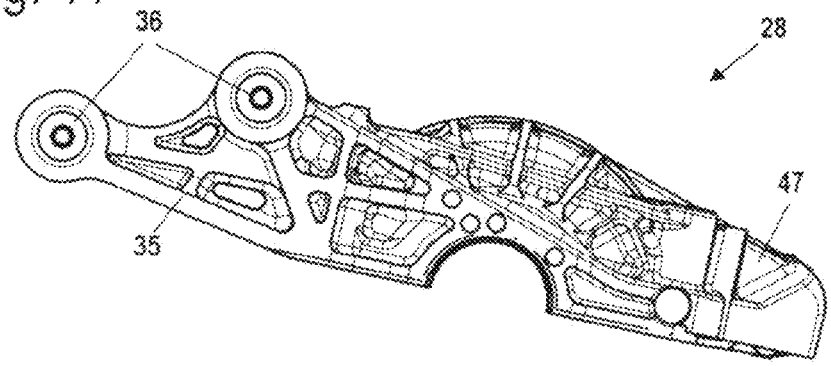
FIG. 11 shows the crankcase sump in the side elevation view of FIGS. 9 and 10.

FIG. 10 shows the arrangement of the ignition module 31 on the outer periphery of the fan wheel 19. The ignition module 31 is fixed with attachment elements 52, preferably threaded fasteners, to the attachment stubs 36 (FIGS. 9 and 11). As shown in FIG. 10, the ignition module 31 has a connector 51 for the lead 32 for connecting to the spark plug 29.

Figure 12:
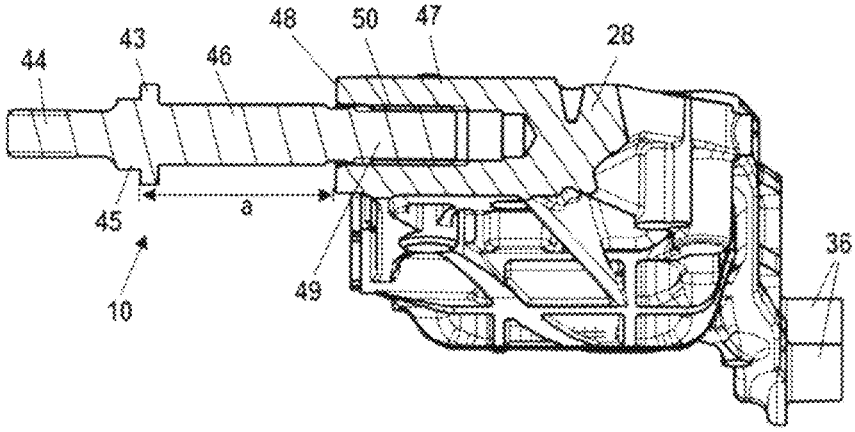
FIG. 12 is a section view taken through the crankcase sump along line XII-XII of FIG. 8.

FIG. 12 shows the arrangement of the attachment bolt 10 in the support section 47 of the crankcase sump 28. The support section 47 has a threaded bore 50 wherein the threaded bolt 10 is threadably engaged with a threaded section 49. The end face of the collar 43 lies facing away from the crankcase sump 28. The end face 48 of the support section 47 is at a distance (a) from this end face of the collar 43. The distance (a) advantageously is approximately one-third to approximately three times the distance (b) between the two bearing seats 38 of the crankcase sump 28.

In the manufacture of a housing component 4, the attachment bolt 10 is first threadably engaged in the crankcase sump 28. Thereafter the component assembly made up of crankcase sump 28 and attachment bolt 10 is placed in the injection molding tool and the plastic of the housing component 4 is injection molded thereover.

Figure 13:
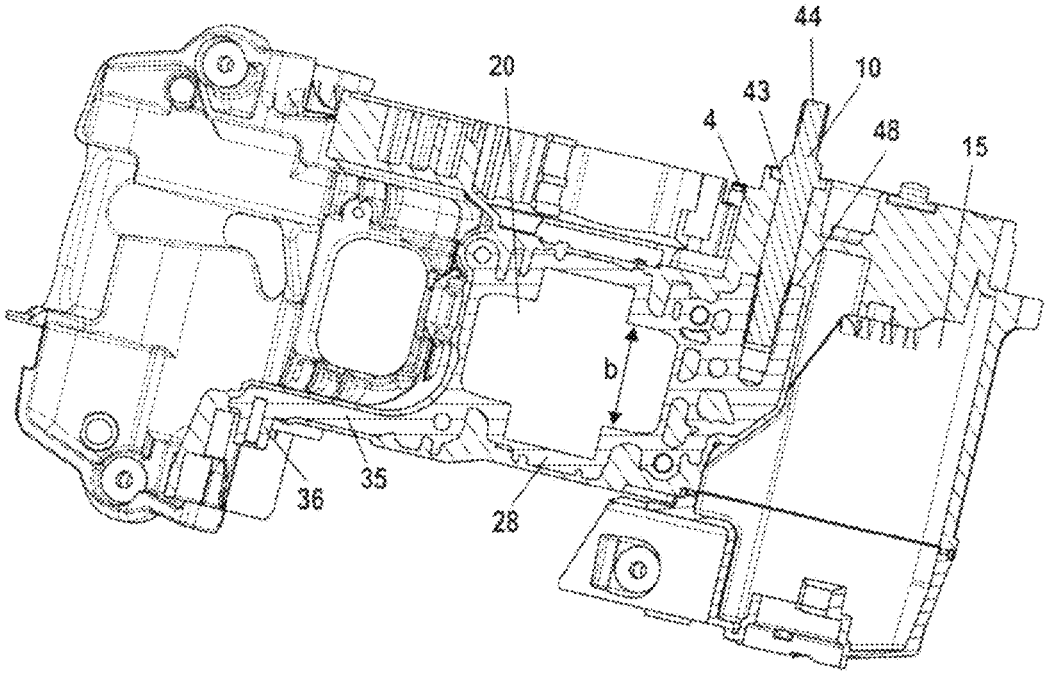
FIG. 13 is a section view taken along line XIII-XIII of FIG. 9.
Figure 14:
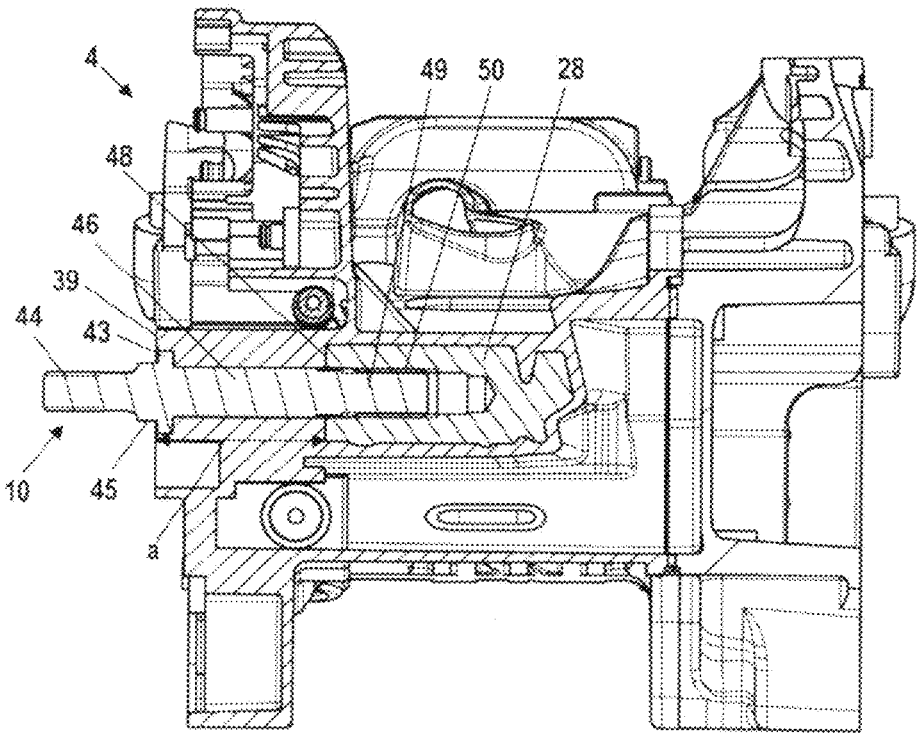
FIG. 14 is a section view taken along line XIV-XIV of FIG. 6.

FIGS. 13 and 14 show the arrangement of the crankcase sump 28 in the housing component 4. As FIG. 13 shows, the crankcase sump 28 is essentially surrounded completely by the material of the housing component 4. Only the attachment stubs 36 for the ignition module 31 and the region, whereat the oil pump 17 is fixed, project outwardly from the housing component 4. Cavities can also be provided in the housing component 4 on the underside of the crankcase sump 28 facing away from the cylinder 21 where material of the housing component 4 is not applied by injection molding. In this way, an improved removal of heat is achieved. At the same time, the force acting by the injection pressure on the crankcase sump 28 is reduced. It can, however, also be provided that the crankcase sump 28 is surrounded completely by the material of the housing component 4 at its lower side facing away from the cylinder 21.

As FIGS. 13 and 14 show, the collar 43 joins flush with the support surface 39 of the housing component 4. Forces, which are taken up by the attachment bolts 10, are conducted into the material of the housing component 4 via the collar 43. The major portion of the accommodated forces is conducted directly into the crankcase sump 28 via the attachment bolt 10. The attachment bolt 10 can be threadably disengaged out of the crankcase sump 28 and so be easily exchanged because the bridging section 46 is smooth on the outer side and is configured to be cylindrical. The second attachment bolt 11 is not in contact with the crankcase sump; instead, the attachment bolt 11 is held exclusively in the material of the housing component 4. The attachment bolt 11 is advantageously threadably engaged in the material of the housing component 4 so that this attachment bolt 11 is also easily exchangeable.

As shown in FIGS. 13 and 14, the attachment bolt 10 is completely and tightly surrounded by the material of the housing component 4 in the region between the collar 43, that is, the contact surface 39, and the end face 48 so that the attachment bolt 10 is laterally supported in the housing component 4.

The respective connections of the ignition module 31, attachment bolt 10 and oil pump 17 are each inventive concepts independent of each other and can be realized independently of each other.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus comprising:

an internal combustion engine including an ignition unit having an ignition module, an induction component and a spark plug;

said ignition module being configured to supply said spark plug with energy;

a work tool driven by said engine;

said engine including a crankcase and a crankshaft;

said crankcase being formed, at least partially, by a crankcase sump made of metal;

said crankshaft being rotatably mounted in said crankcase;

said an induction component being fixedly connected to said crankshaft so as to rotate therewith and being configured to induce a voltage in said ignition module;

a housing component made of plastic and the plastic of said housing component being injection molded around said crankcase sump; and, said ignition module being fixed directly and electrically conductively to said crankcase sump made of metal.

2. The portable handheld work apparatus of claim 1, wherein said crankcase sump has a protruding arm; and, said ignition module is fixed on said protruding arm.

3. The portable handheld work apparatus of claim 2, wherein said arm has two attachment stubs formed thereon and projecting out of said material of said housing component; and, said ignition module is fixedly mounted on said stubs.

4. The portable handheld work apparatus of claim 1, further comprising a tank at least partially delimited by said housing component.

5. The portable handheld work apparatus of claim 1, further comprising at least one attachment element for a work tool carrier for said work tool; and, said attachment element being fixed on said crankcase sump.

6. The portable handheld work apparatus of claim 5, wherein said housing component defines a support surface for accommodating said work tool carrier; and, said attachment element projects through said support surface.

7. The portable handheld work apparatus of claim 6, wherein said crankcase sump has an end face facing toward said support surface; said end face is offset relative to said support surface into the interior of said housing component; and, said end face is at a distance (a) measured along a perpendicular to said support surface.

8. The portable handheld work apparatus of claim 7, said engine including a crankshaft and two bearings for journaling said crankshaft; said crankcase sump having two bearing seats for accommodating corresponding ones of said bearings therein; said bearing seats being spaced at a distance (b) from each other; and, said distance (a) being in a range from approximately one-third to approximately three times said distance (b).

9. The portable handheld work apparatus of claim 7, said attachment element having a segment disposed between said support surface and said end face; and, said segment being surrounded by said material of said housing component.

10. The portable handheld work apparatus of claim 9, wherein said attachment element has a smooth surface on said segment thereof.

11. The portable handheld work apparatus of claim 6, wherein said attachment element has a collar ending flush with said support surface; and, said collar is embedded in said material of said housing component.

12. The portable handheld work apparatus of claim 5, wherein said crankcase sump has a support section whereat said attachment element is fixed.

13. The portable handheld work apparatus of claim 5, wherein said attachment element is an attachment bolt threadably engaged in said crankcase sump.

14. The portable handheld work apparatus of claim 5, wherein said attachment element is a first attachment element and said work apparatus further comprises a second attachment element for said work tool carrier; and, said second attachment element is secured in said material of said housing component at a spacing to said crankcase sump.

15. The portable handheld work apparatus of claim 1, said engine including a crankshaft; and, said work apparatus further comprising an oil pump driven by said internal combustion engine for supplying a lubrication medium to said work tool; and, said crankcase sump having positioning means for fixing the position of said oil pump relative to said crankshaft.

16. The portable handheld work apparatus of claim 15, wherein said oil pump is attached directly to said crankcase sump.

17. The portable handheld work apparatus of claim 16, wherein the region of said crankcase sump whereat said oil pump is attached is not injection molded by said material of said housing component.

18. The portable handheld work apparatus of claim 16, wherein said positioning means are spaced from attachment locations whereat said oil pump is attached to said crankcase sump.

19. A method of making a work apparatus having a work tool, the work apparatus including an internal combustion engine for driving the work tool; the internal combustion engine having a crankcase configured to be formed at least partially of a crankcase sump made of metal; the engine further including a crankshaft rotatable journalled in the crankcase and an ignition device having a spark plug and ignition module for supplying the spark plug with energy; the ignition device further including a component connected to said crankshaft to rotate therewith and induce a voltage in said ignition module; the work apparatus further including a housing component made of plastic; the method comprising the steps of:

providing at least one attachment element for attaching a work tool carrier;

fixing said attachment element on said metal crankcase sump;

then, injection molding the plastic of said housing component around said crankcase sump; and, fixing said ignition module directly and electrically conductively to said metal crankcase sump.

20. The method of claim 19, wherein said attachment element is threadably engaged with said crankcase sump.

* * * * *